US007841206B2

(12) United States Patent
Choi et al.

(10) Patent No.: US 7,841,206 B2
(45) Date of Patent: Nov. 30, 2010

(54) REFRIGERATOR

(75) Inventors: Bong Jun Choi, Changwon-shi (KR); Jong Min Sin, Pusan (KR); Jae Seong Sim, Masan-si (KR); Young Jeong, Gwagmyeong-si (KR); Young Hwan Ko, Changwon-si (KR); Jun Hyun Hwang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 749 days.

(21) Appl. No.: 10/583,602

(22) PCT Filed: Dec. 14, 2004

(86) PCT No.: PCT/KR2004/003288

§ 371 (c)(1),
(2), (4) Date: Aug. 13, 2007

(87) PCT Pub. No.: WO2005/061977

PCT Pub. Date: Jul. 7, 2005

(65) Prior Publication Data

US 2008/0000257 A1 Jan. 3, 2008

(30) Foreign Application Priority Data

Dec. 20, 2003 (KR) ..... 10-2003-0094248
Dec. 20, 2003 (KR) ..... 10-2003-0094249
Dec. 20, 2003 (KR) ..... 10-2003-0094250

(51) Int. Cl.
*F25D 17/04* (2006.01)
*F25D 17/06* (2006.01)

(52) U.S. Cl. ..... 62/408; 62/404; 62/419; 62/407

(58) Field of Classification Search ..... 62/404, 62/408, 419
See application file for complete search history.

(56) References Cited

U.S. PATENT DOCUMENTS 3,175,373 A * 3/1965 Holkeboer et al. ..... 62/268
3,428,040 A * 2/1969 Baker et al. ..... 126/110 R
4,135,440 A * 1/1979 Schmidt et al. ..... 454/185
4,920,758 A * 5/1990 Janke et al. ..... 62/187
5,368,072 A * 11/1994 Cote ..... 137/872
5,778,694 A * 7/1998 Jeong ..... 62/187

(Continued)

FOREIGN PATENT DOCUMENTS

CN 1204759 1/1999

(Continued)

*Primary Examiner*—William E Tapolcai
*Assistant Examiner*—Filip Zec
(74) *Attorney, Agent, or Firm*—KED & Associates, LLP

(57) ABSTRACT

A refrigerator having a main body includes a refrigerating chamber and a freezing chamber provided for storing foods. A cool air-generating device provided in the body generates cool air and a cool air-supplying device including at least one opening for discharging the cool air, is used to circulate the cool air through the freezing chamber, the refrigerating chamber, and the cool air-generating device. A separator provided adjacent to the opening acts to uniformly diffuse the cool air in the freezing chamber and the refrigerating chamber. The separator acts to separate two flows that are then brought back together. The collision and mixing of the two flows create a turbulent flow of air that is directed into the refrigerating and freezing chambers.

27 Claims, 17 Drawing Sheets

U.S. PATENT DOCUMENTS

| | | | | |
|---|---|---|---|---|
| 6,009,720 | A * | 1/2000 | Ji et al. | 62/413 |
| 6,053,162 | A * | 4/2000 | Godfree et al. | 126/85 B |
| 6,394,008 | B1 * | 5/2002 | Bauver et al. | 110/184 |
| 6,625,998 | B2 * | 9/2003 | Kim et al. | 62/186 |
| 2003/0041606 | A1 | 3/2003 | Kim et al. | |
| 2004/0261444 | A1 * | 12/2004 | Chastine | 62/441 |

FOREIGN PATENT DOCUMENTS

| | | |
|---|---|---|
| CN | 2442202 Y | 8/2001 |
| CN | 1401958 | 3/2003 |
| JP | 10-054639 | 2/1998 |

* cited by examiner

REFRIGERATOR

TECHNICAL FIELD

The present invention relates to a refrigerator, and more particularly, to a refrigerant circulating device of the refrigerator.

BACKGROUND ART

In general, a refrigerator is an apparatus for storing foods at a low temperature in a freezing chamber and a refrigerating chamber. To maintain the low temperature in the freezing chamber and the refrigerating chamber, the refrigerator generates cool air by using a freezing cycle of compressing-condensing-expanding-evaporating. Then, the generated cool air is provided to and circulated in the freezing chamber and the refrigerating chamber using a supplying device. The supplying device is comprised of a passage or duct for supplying the cool air from the freezing cycle to the refrigerating chamber and the freezing chamber. Openings in the walls of the refrigerating and freezing chambers discharge the cool air into the refrigerating chamber and the freezing chamber.

Typically, the openings are relatively small as compared with a volume in the freezing chamber and the refrigerating chamber. As a result, it is impossible to discharge a large amount of cool air into the refrigerating chamber and the freezing chamber in a short time. Also because the discharged cool air has a relatively high flow rate, the discharged cool air flows in a specific direction out of the openings, and more particularly, a straightforward direction. As a result, the cool air is not uniformly diffused in the entire refrigerating chamber and the entire freezing chamber.

DISCLOSURE OF INVENTION

An object of the present invention, designed for solving the foregoing problems, is to provide a refrigerator for uniformly providing a cool air to the inside of the refrigerating and freezing chambers.

A refrigerator embodying the present invention includes a body; a refrigerating chamber and a freezing chamber provided in the body, for taking storage of foods; a cool air-generating device provided in the body, a cool air-supplying device including at least one opening for discharging cool air into the freezing chamber and refrigerating chamber; and a separator provided adjacent to the opening, for uniformly diffusing the cool air in the freezing chamber and the refrigerating chamber by separating the cool air into at least two streams. The separator is provided to partially block the cool air being discharged from the opening. The separator may extend perpendicular to a flowing direction of the cool air.

The separator may be configured to generate at least two vortexes in the discharged cool air that rotate in opposite directions. The vortexes have a size and an intensity that are different and that continuously change. Also, the separator is configured to allow the separated flows of cool air to collide with each other before they are discharged into the refrigerating and freezing chambers. The separated flows of the cool air collide with each other in a straight line, and at a predetermined angle. The separator may be formed as a flat member. Also, the separator may have a round shape that protrudes opposite to a flowing direction of the cool air. The separator may be formed of an angularly bent shape that protrudes in the flowing direction of the cool air. Also, the separator may be formed of an oval shape wherein both sides are round in the forward and opposite directions of the cool air. A plurality of protrusions or dimples may be formed on the surface of the separator.

Two opposite passages are formed between the separator and the opening, and the separated flows of cool air pass along the two opposite passages. In some embodiments, the opening is positioned adjacent to a crossing point where the separated flows of the cool air come back together. In addition, an interval between the separator and the opening is equivalent to (or smaller than) a width of the opening. Preferably, an interval between the separator and the opening is about 0.5 times a width of the opening. Also, preferably, a width of the separator is equivalent to a width of the opening.

The opening is configured to discharge the generated cool air to the freezing chamber and the refrigerating chamber. Preferably, the opening is configured to discharge the generated cool air to the freezing chamber and the refrigerating chamber in at least two different directions. Also, the openings within a chamber may be configured to discharge the generated cool air to the freezing chamber and the refrigerating chamber, in two different directions that are substantially perpendicular to each other.

One or more openings that lead back towards the cool air-generating device may also include separators. In more detail, such openings discharge the cool air which has been circulated in the freezing chamber and the refrigerating chamber back towards an evaporator of the cool air-generating device. Preferably, the refrigerator would include one or more auxiliary ducts that extend from the refrigerating and freezing chambers to the evaporator of the cool air-generating device, for directly discharging the cool air circulated in the freezing chamber and the refrigerating chamber to the evaporator. A separator would be positioned adjacent to an opening of the auxiliary duct.

The ducts that deliver cool air to the refrigerating and freezing chamber may be expanded at locations immediately adjacent the opening into the inside of the refrigerating chamber and/or the freezing chamber. Preferably, the ducts have an expanded portion adjacent to the separator. Also, a width of the expanded portion is preferably about 2 to 2.5 times of a width of the corresponding duct, and a height of the expanded portion is about 1 to 1.2 times of a width of the corresponding duct. The duct is gradually expanded. More preferably, a sidewall of the expanded portion is inclined at a predetermined angle relative to a sidewall of the duct.

A refrigerator embodying the invention may have a plurality of openings and separators, wherein the separators are respectively positioned adjacent to the openings. In this case, the adjacent separators oscillate the discharged cool air in perpendicular directions. Preferably, the adjacent separators are configured to separate the discharged cool air in different directions. Also, the separators may further include one pair of supports that extend from the opposite sides of the separator near to the opening.

BRIEF DESCRIPTION OF DRAWINGS

The accompanying drawings, which are included to provide a further understanding of the invention, illustrate embodiment(s) of the invention and together with the description serve to explain the principle of the invention. In the drawings.

DETAILED DESCRIPTION OF PREFERRED EMBODIMENTS

Reference will now be made in detail to the preferred embodiments of the present invention, examples of which are illustrated in the accompanying drawings.

Figure 1:
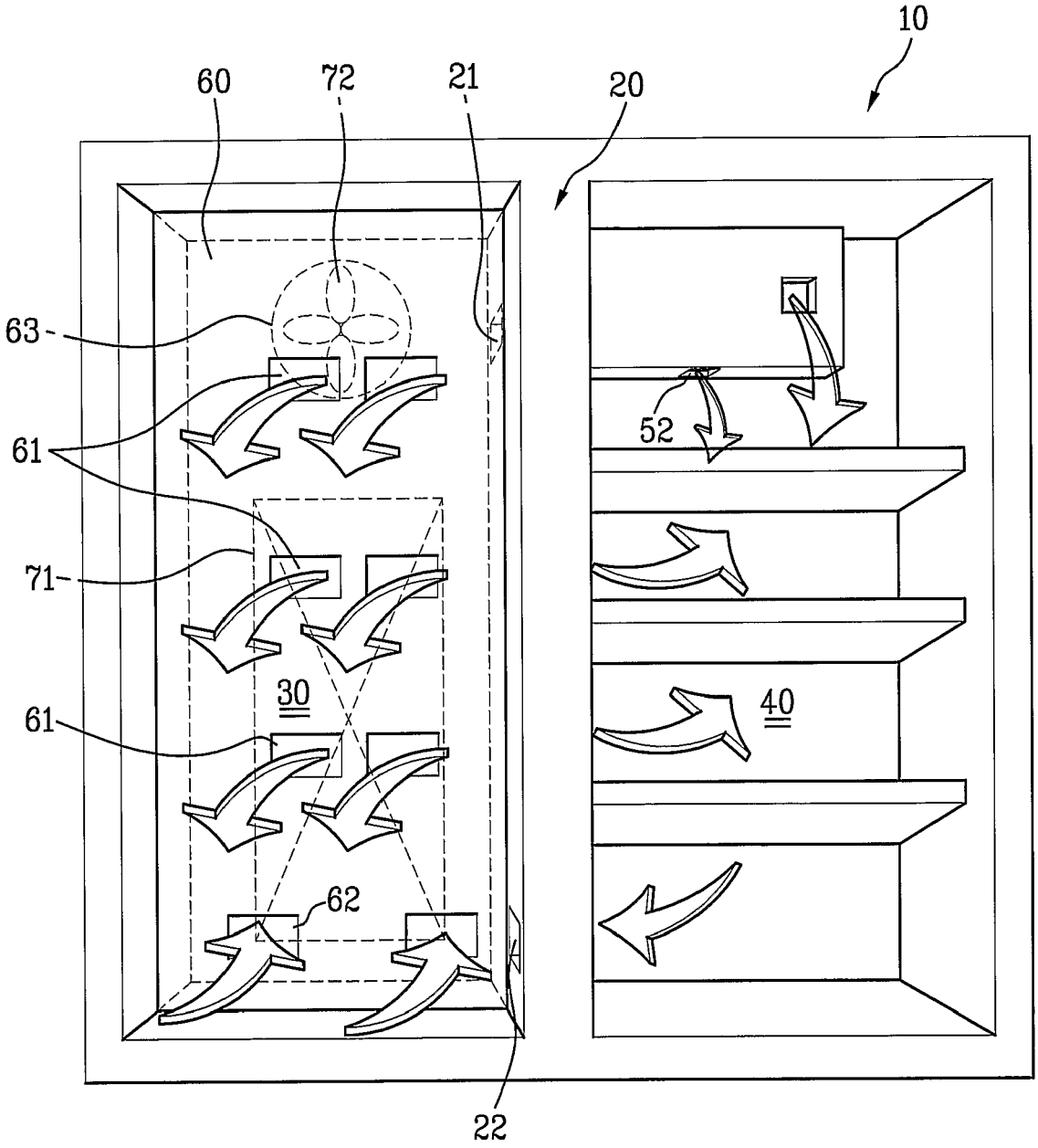
FIG. 1 is a front view of a refrigerator according to the present invention.
Figure 2:
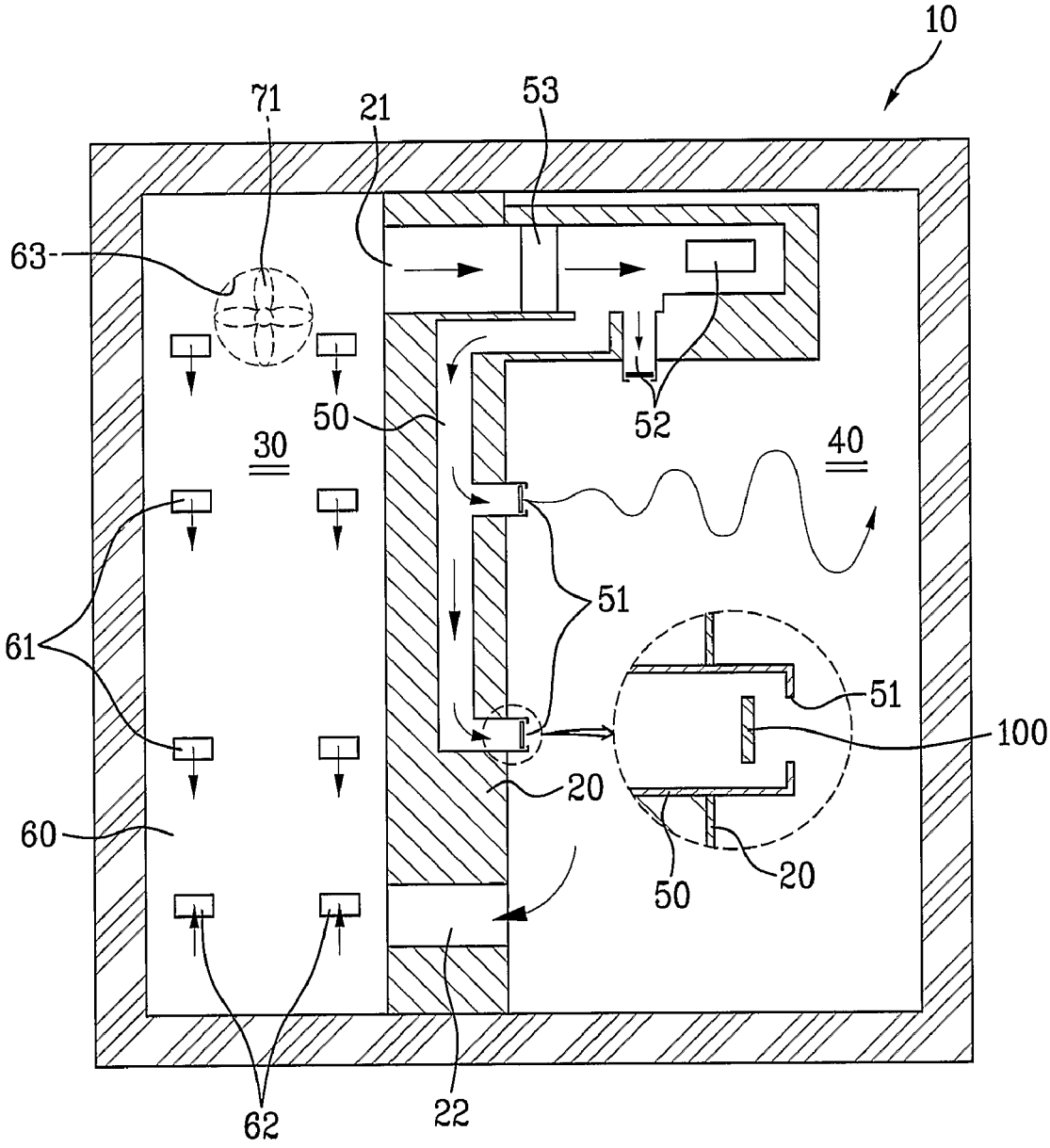
FIG. 2 is a front sectional view of a refrigerator according to a first embodiment of the present invention.
Figure 3:
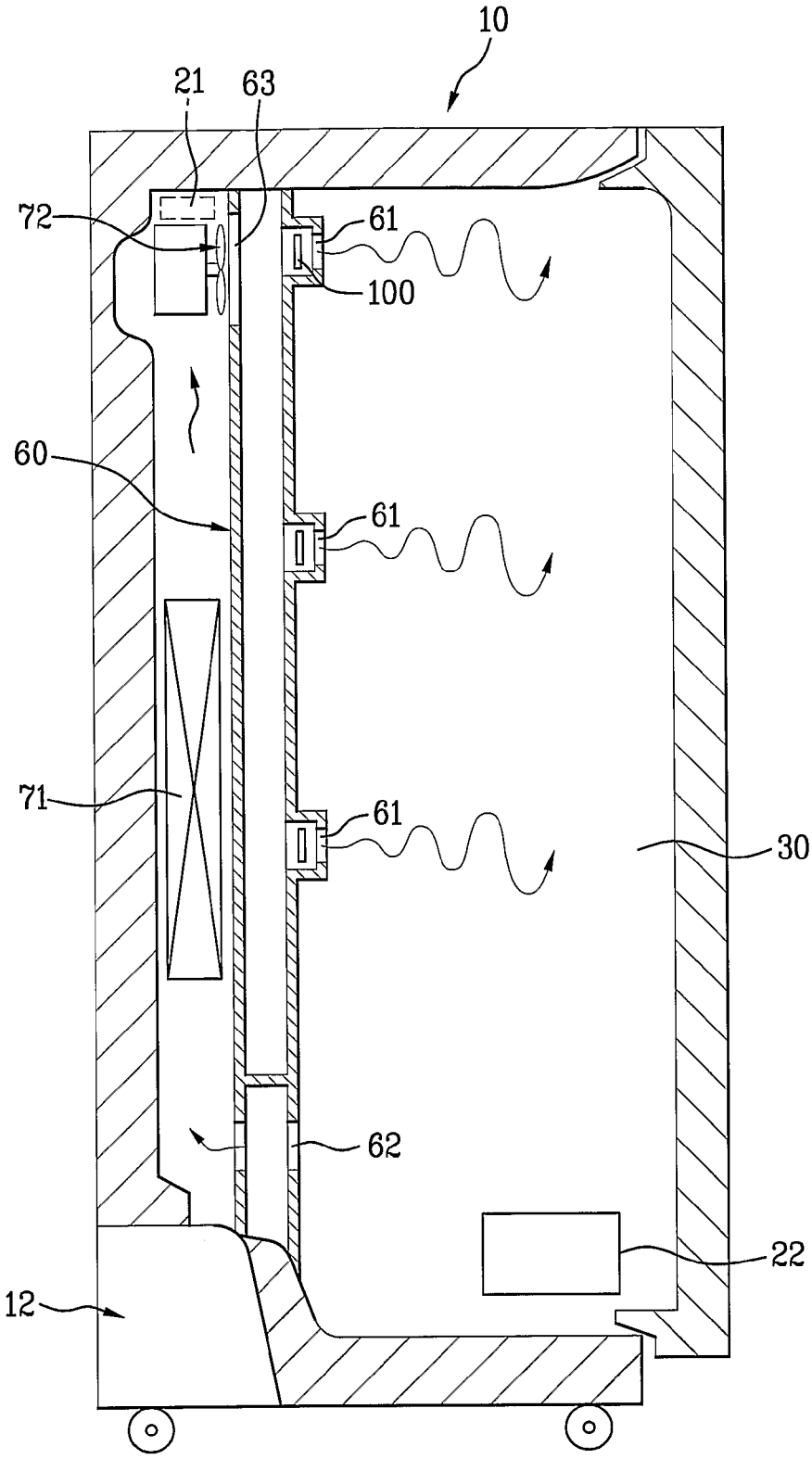
FIG. 3 is a cross sectional view of a refrigerator according to the first embodiment of the present invention.

FIG. 1 is a front view of a refrigerator according to the present invention. FIG. 2 is a front sectional view of a refrigerator according to a first embodiment of the present invention. FIG. 3 is a cross sectional view of a refrigerator according to the first embodiment of the present invention. As shown in the drawings, the refrigerator according to the first embodiment of the present invention includes a body 10, a freezing chamber 30, a refrigerating chamber 40, a cool air-generating device, and a cool air-supplying device.

The freezing chamber 30 holds frozen foods, and the refrigerating chamber 40 keeps foods cold, so that foods are stored freshly. The freezing chamber 30 and the refrigerating chamber 40 are formed by dividing an inner space of the body 10 with a barrier 20.

In the refrigerator according to the first embodiment of the present invention, the freezing chamber 30 and the refrigerating chamber 40 are positioned side by side. Alternatively, the freezing chamber 30 and the refrigerating chamber 40 may be positioned up and down.

The cool air-generating device is configured to generate cool air which is discharged into the freezing chamber 30 and the refrigerating chamber 40. The cool air-generating device is provided with a compressor, a condenser, an expanding valve, and an evaporator 71. The compressor makes a low temperature/low pressure gaseous refrigerant into a high temperature/high pressure gaseous refrigerant, and the condenser condenses the gaseous refrigerant provided from the compressor. Also, the expanding valve lowers the pressure of the refrigerant provided from the condenser. Then, the evaporator 71 evaporates the refrigerant passing through the expanding valve in state of the low pressure, to absorb heat from the surrounding air. Thus, the surrounding air is cooled.

As shown in FIG. 3, the compressor and the condenser (not shown) are provided in a machine room 12 at a lower portion of the body 10. Also, the evaporator 71 is provided in an additional room adjacent to the freezing chamber 30 and the refrigerating chamber 40. In addition, a fan or a blower 72 is also provided in the additional room adjacent to the evaporator 71 so that the air is continuously circulated inside the refrigerator.

The cool air-supplying device discharges cool air generated by the cool air-generating device to the freezing chamber 30 and the refrigerating chamber 40. Also, the cool air-supplying device re-circulates the cool air from the refrigerating and freezing chambers back into the evaporator 71. That is, the cool air-supplying device continuously provides and circulates the cool air through the freezing chamber 30 and the refrigerating chamber 40, and then back to the evaporator 71, whereby the freezing chamber 30 and the refrigerating chamber 40 are respectively maintained below a specific temperature. The cool air-supplying device may be provided with a first supplying part for the refrigerating chamber 40, and a second supplying part for the freezing chamber 30.

Referring to FIG. 2, the first supplying part is comprised of a first duct 50 for guiding the cool air to the refrigerating chamber 40, and first and second openings 51 and 52 for discharging the guided cool air to the refrigerating chamber 40. As shown in FIG. 1 and FIG. 3, the first duct 50 is in communication with the room for the evaporator 71 by a first middle opening 21 provided in the barrier 20. Accordingly, the cool air is directly provided to the first duct 50 through the first middle opening 21.

The first and second openings 51 and 52 are positioned at the upper and lateral sides of the refrigerating chamber 40 for smoothly supplying the cool air to the refrigerating chamber 40. If necessary, a plurality of first and second openings 51 and 52 may be provided to the refrigerating chamber 40. Also, a second middle opening 22 is provided at a lower side of the barrier 20, wherein the second middle opening 22 is in communication with both the refrigerating chamber 40 and the freezing chamber 30. Thus, the cool air of the refrigerating chamber 40 is discharged to the freezing chamber 30 through the second middle opening 22.

The second supplying part is provided with a second duct 60 for guiding the cool air to the freezing chamber 30 and the evaporator 71. At least one or more third and fourth openings 61 and 62 being in communication with the second duct 60. As shown in FIG. 3, the second duct 60 is provided between the freezing chamber 30 and the evaporator 71. The second duct 60 is in communication with the evaporator 71 by a third middle opening 63, and the second duct 60 receives the cool air from the evaporator 71 by the fan 72. The third opening 61 discharges the cool air of the second duct 60 to the freezing chamber 30. The fourth opening 62 discharges the cool air of the freezing chamber 30 to the evaporator 71 so as to cool the air.

In this refrigerator according to the present invention, the air is cooled while passing through the evaporator 71 by the fan 72. Subsequently, the cool air is provided to the first duct 50 and the second duct 60 through the first middle opening 21 and the third middle opening 63. After that, the cool air is discharged to the refrigerating chamber 40 through the first opening 51 and the second opening 52, and is discharged to the freezing chamber 30 through the third opening 61.

However, as explained above, in related art refrigerators, the cool air doesn't uniformly reach the freezing chamber 30 and the refrigerating chamber 40 due to the small-sized first, second, and third openings 51, 52, 61 and the circulation speed/direction of the cool air. Thus, in case of the refrigerator according to the first embodiment of the present invention, as shown in FIG. 2 to FIG. 4, separators 100 are provided in the openings 51, 52, 61 for discharging the generated cool air to the freezing chamber 30 and the refrigerating chamber 40.

Figure 4:
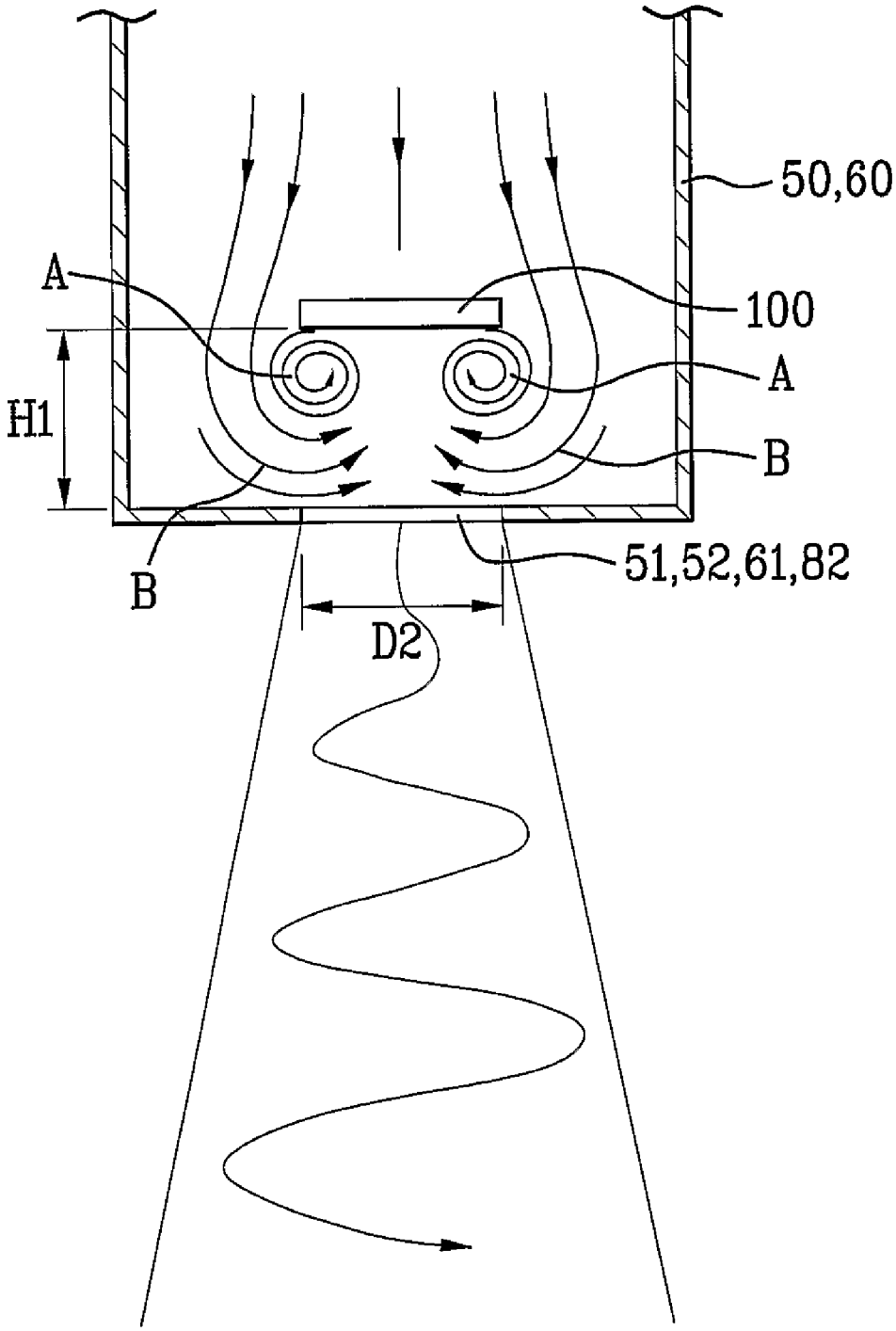
FIG. 4 is a partially expanded sectional view of a separator according to the first embodiment of the present invention.

As shown in FIG. 4, each of the separators 100 separates the cool air into at least two separate flows before discharging the cool air. That is, the separators 100 are provided adjacent to the openings 51, 52, 61, and more particularly, not inside the freezing chamber 30 and the refrigerating chamber 40 but inside the ducts 50, 60. The separators 100 serve to decrease the circulation speed of the cool air, and to diffuse the cool air more uniformly throughout the freezing chamber and the refrigerating chamber.

The separators 100 extend in a direction that is substantially perpendicular to the flowing direction of the cool air, thereby separating the cool air into multiple flows, and simultaneously decreasing the circulation speed of the cool air. Preferably, the separators 100 are formed of flat members. Although not shown, the separators 100 are fixed to the inner surfaces of the ducts 50 and 60. Preferably, as shown in FIG. 2 and FIG. 3, the portion of the ducts 50 and 60 adjacent the openings have a diameter that is greater than the diameter of the openings.

Before discharging the cool air, the cool air collides with the separators 100, thereby forming a turbulent flow. The turbulent flow tends to generate several vortexes around the separators 100. An adverse pressure gradient is generated in a flow boundary layer formed on the surface of the separators 100, so that the separated flows of the cool air cause the separation at both ends of the separators 100. The separation generates at least two vortexes A between the separator 100 and the openings 51, 52, 61. The vortexes A flow in opposite directions from the ends of the separators 100. Each vortex A has a specific frequency dependent on a shape and a dimension of the separator 100, and also has an intensity and a size that are different from each other, and that vary continually. The discharged flow is excited by the vortexes between the separator 100 and the openings 51, 52, 61. As a result, the flow of cool air into the refrigerating/freezing chamber tends to oscillate and move, and the cool air is uniformly diffused into the freezing chamber 30 and the refrigerating chamber 40.

Also, as shown in FIG. 4, insertion of the separator 100 in the duct forms two passages between the separator 100 and the openings 51, 52, 61. The two passages are substantially opposite to each other and the separated cool air flows along the two passages. The passages substantially function as nozzles that form two jets B. As the two jets B collide with each other, surrounding static pressure rises above an atmospheric pressure, thereby contributing to the turbulent flow. That is, this collision strengthens the vortex A generated by the separation of the cool air. Thus, the cool air oscillates greatly, so that the cool air is uniformly diffused and provided to the freezing chamber and the refrigerating chamber.

To obtain the maximum efficiency on diffusion of the flow, it is necessary to directly discharge the cool air into the refrigerating/freezing chamber at the location of maximum excitation from the vortexes A. Accordingly, the openings 51, 52, 61 are positioned adjacent to points of inference between the two vortexes A. The cool air experiences its maximum excitement at the point the jets B meet. In this respect, it is preferable to position the openings 51, 52, 61 adjacent to the point where the jets B meet. In due consideration of the aforementioned explanation, if an interval Hi between the separator 100 and the opening 51, 52, 61 is larger than a width of the opening 51, 52, 61, the flow resistance increases substantially. Preferably, the interval Hi is the same as (or less than) the width D2 of the opening 51, 52, and 61. On the other hand, when the interval H1 is too small, it is hard to form and grow the vortexes A. Thus, preferably, the interval H1 is at least 0.5 times of the width D2 of the opening 51, 52, and 61. Also, in forming the passages for the jets B and the vortexes A, it is useful to form the separator 100 in correspondence with the width D2 of the opening 51, 52, and 61.

Figure 5A:
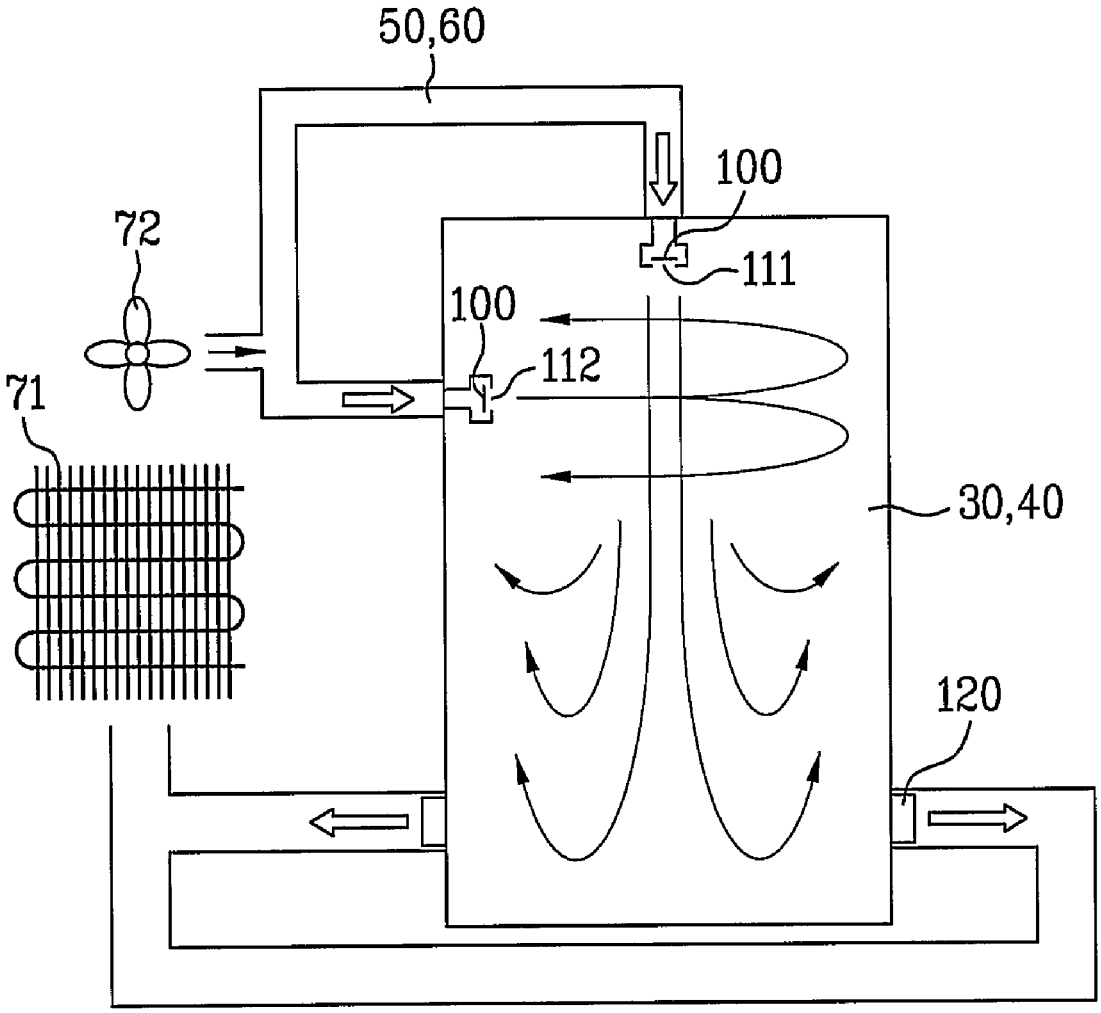
FIG. 5A and FIG. 5B are schematic views of a cool air-supplying device according to the first embodiment of the present invention.
Figure 5B:
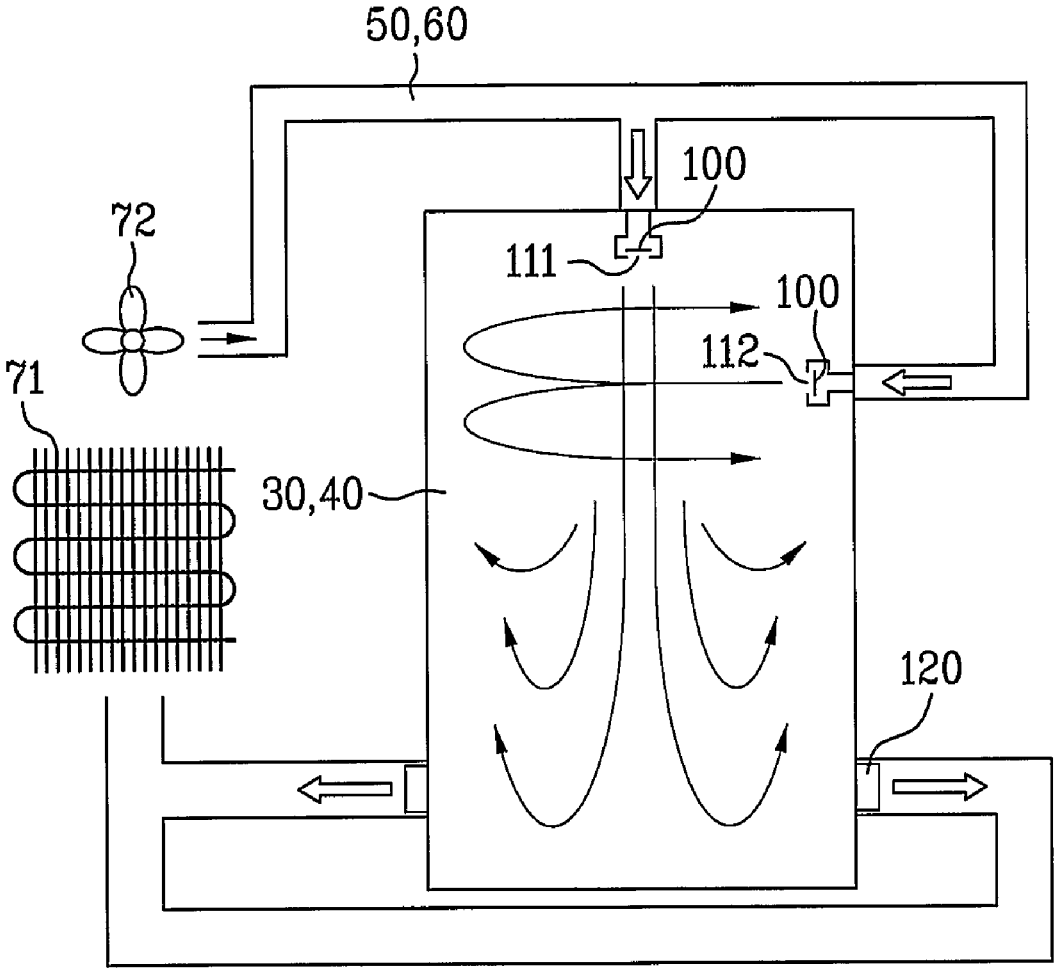
Figure 6A:
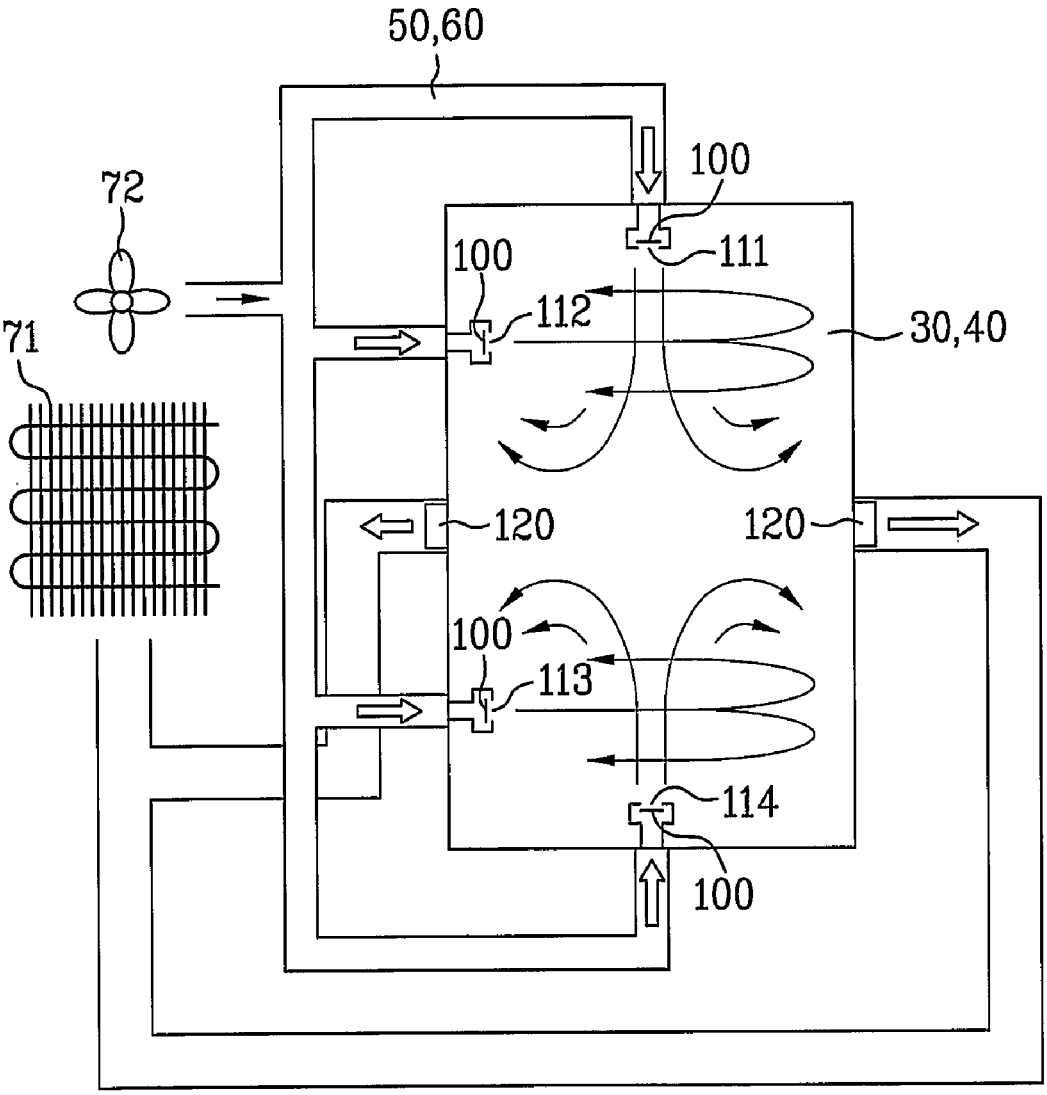
FIG. 6A and FIG. 6B are schematic views of a modified cool air-supplying device according to the first embodiment of the present invention.
Figure 6B:
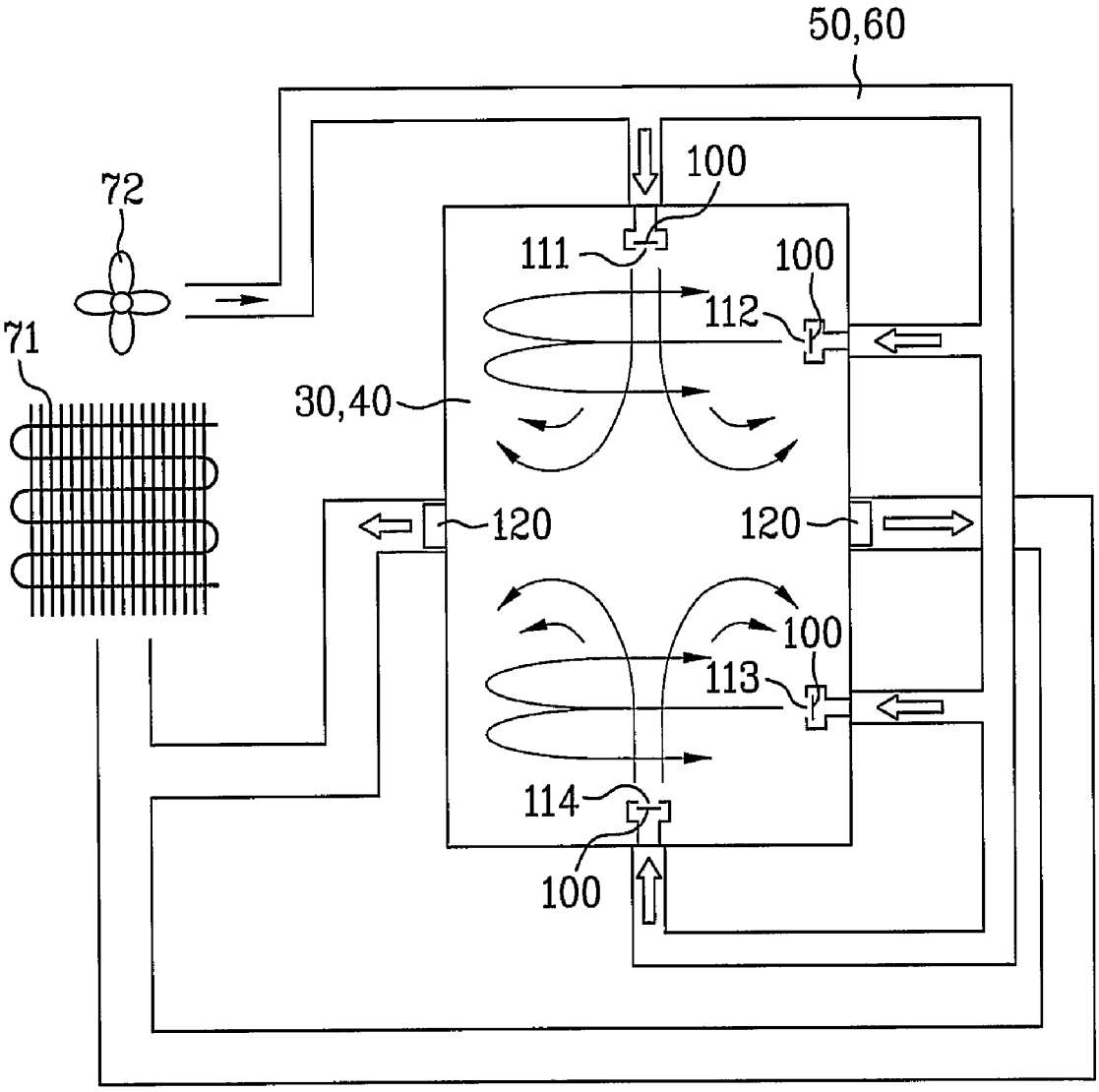
Figure 7:
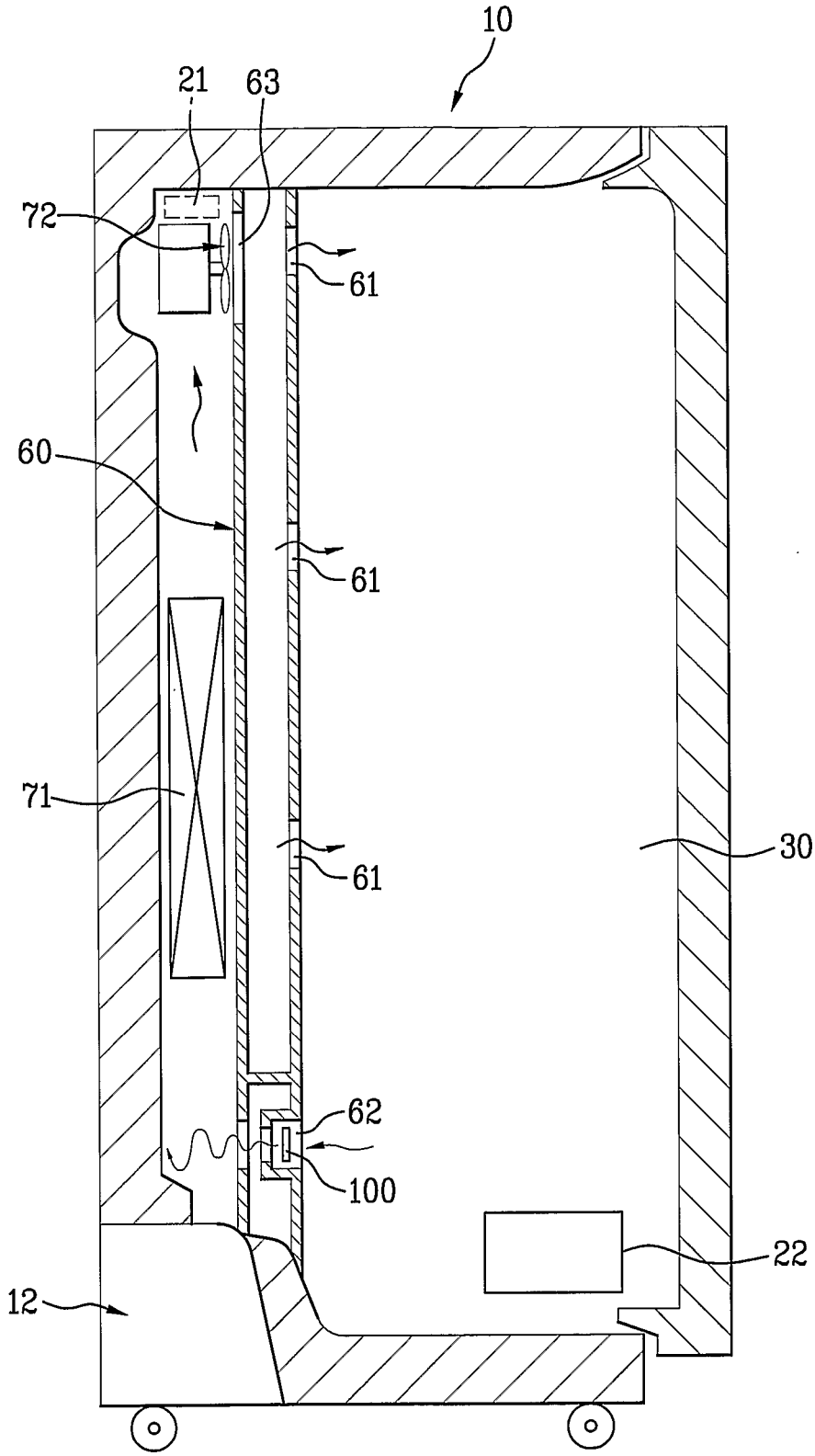
FIG. 7 is a cross sectional view of a refrigerator according to a second embodiment of the present invention.

An orientation of the separators 100 with respect to the openings 51, 52, 61 is also very important for the uniform diffusion of the cool air, and this will be described with reference to FIG. 5A to FIG. 6B. FIG. 5A and FIG. 5B are schematic views of a cool air-supplying device according to the first embodiment of the present invention. FIG. 6A and FIG. 6B are schematic views of a modified cool air-supplying device according to the first embodiment of the present invention. The cool air-supplying device will be described with the reference to FIG. 5A to FIG. 6B, which will be explained in comparison with FIG. 1 to FIG. 3.

First, as shown in FIG. 5A and FIG. 5B, the cool air-supplying device has openings for discharging the generated cool air in different directions. In more detail, the openings are comprised of first inlets 111 provided at a top wall of the freezing chamber 30 and the refrigerating chamber 40, and second inlets 112 provided at a sidewall of the freezing chamber 30 and the refrigerating chamber 40.

At this time, the first inlet 111 discharges the cool air toward the lower portion of the freezing chamber 30 and the refrigerating chamber 40. The first inlet 111 discharges cool air substantially perpendicular to the cool air discharged from the second inlet 112. Also, the second inlet 112 discharges the cool air toward the upper portion of the opposite sidewall. Accordingly, the oscillated cool air is discharged from the different portions of the freezing chamber 30 and the refrigerating chamber 40 through the first and second inlets 111 and 112. A substantial range of discharging the cool air becomes wide, which is advantageous to the uniform diffusion of the cool air in the freezing chamber 30 and the refrigerating chamber 40. To obtain the same result, the first and second inlets 111 and 112 may be positioned as shown in FIG. 5B.

Because the cool air flows from the inlets in perpendicular, crossing directions, the flows intermix, which increases the turbulence of the overall flow. Thus, the oscillated cool air is uniformly diffused in the freezing chamber 30 and the refrigerating chamber 40. Simultaneously, this also helps to obtain a uniform temperature distribution.

Also, the cool air-supplying device has outlets 120 for discharging the cool air from the freezing chamber 30 and the refrigerating chamber 40 back to the cool air generating device. The outlets 120 are provided at lower sides of the freezing chamber 30 and the refrigerating chamber 40, so that the cool introduced through the inlets 111 and 112 is not immediately discharged. Preferably, the outlets 120 are provided on both lower sidewalls of the freezing chamber 30 and the refrigerating chamber 40, to discharge the cool air rapidly.

In connection with the freezing chamber 30, the second supplying part shown in FIG. 1 to FIG. 3 has only the third opening 61 corresponding to the second inlet 112. Referring to FIG. 1 to FIG. 3, in connection with the refrigerating chamber 40, the first supplying part has both the first and second openings 51 and 52 corresponding to the first and second inlets 111 and 112. Thus, in the refrigerator of FIG. 1 to FIG. 3, preferably, the second supplying part for the freezing chamber 30 has the additional opening corresponding to the first inlet 111. Also, in the freezing chamber 30, the outlet 120 corresponds to the fourth opening 62. In the refrigerating chamber 40, the outlet 120 corresponds to the second middle opening 22.

Preferably, as shown in FIG. 6A, the cool air-supplying device further includes third and fourth inlets 113 and 114, wherein the third and fourth inlets 113 and 114 function as openings. In this case, the third inlet 113 is provided at a lower portion in a sidewall of the freezing chamber 30 and the refrigerating chamber 40, below the second inlet 112. Thus, the third inlet 113 discharges the cool air toward a lower portion of an opposite sidewall. The fourth inlet 114 is provided on a bottom wall of the freezing chamber 30 and the refrigerating chamber 40, for discharging the cool air toward an upper portion of the freezing chamber 30 and the refrigerating chamber 40.

In the same way as the first and second inlets 111 and 112, the third inlet 113 discharges cool air perpendicular to the cool air discharged from the fourth inlet 114. The additional third and fourth inlets 113 and 114 further increase the turbulent flow in the chambers, and provide for a more uniform distribution of the cool air.

The third and fourth inlets 113 and 114 may be provided as shown in FIG. 6B, which has essentially the same effect as the arrangement shown in FIG. 6A. In relation to the refrigerator of FIG. 1 to FIG. 3, the first supplying part and the second supplying part respectively have the openings 51 and 61 corresponding to the third inlets 113. Accordingly, it is preferable for the first supplying part and the second supplying part to have the additional openings corresponding to the fourth inlets 114. Also, preferably, the outlets 120 are provided on the center of the sidewalls of the freezing chamber 30 and the refrigerating chamber 40. This presents cool air introduced through the inlets 111, 112, 113, and 114 from being immediately discharged.

Because the evaporator 71 tends to be relatively wide in prior art refrigerators, the cool air discharged from the fourth opening 62 is directed towards the center of the evaporator 71. Accordingly, the heat-exchange efficiency of the evaporator 71 is lowered. Also, because little or no heat exchange occurs at the left and right sides of the evaporator 71, frost may generated at the left and right sides of the evaporator 71, thereby lowering the heat-exchange efficiency.

In a refrigerator embodying the invention, as shown in FIG. 7 to FIG. 9B, a separator 100 is provided in the fourth opening 62 for discharging the cool air circulated in the freezing chamber 30 and the refrigerating chamber 40 to the evaporator 71.

Figure 8:
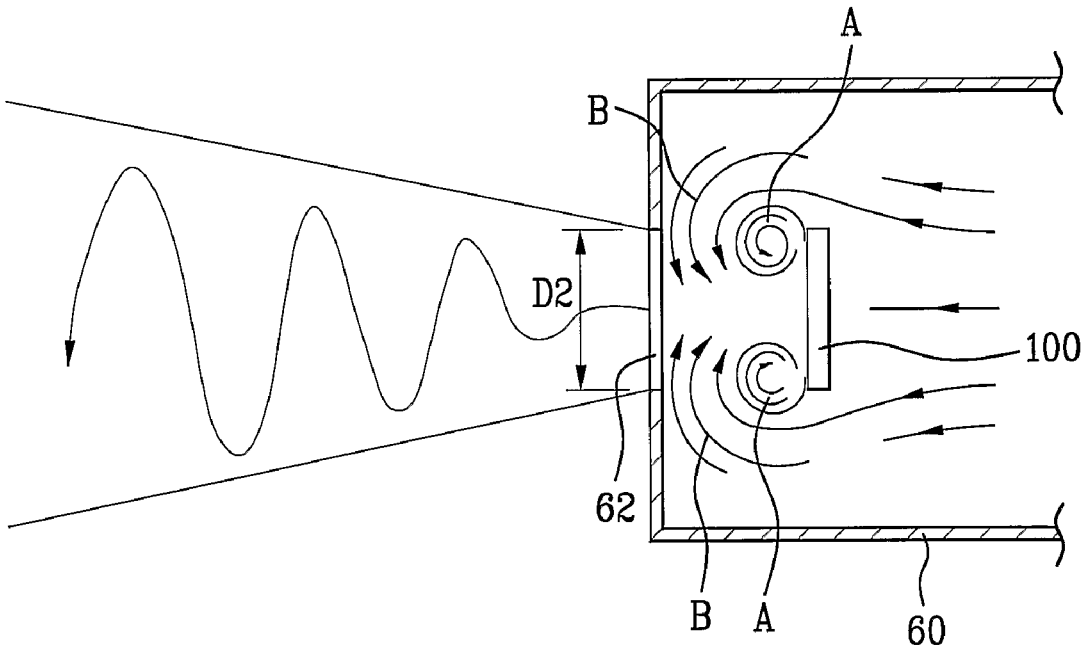
FIG. 8 is a partially expanded sectional view of a separator according to the second embodiment of the present invention.

The separators 100 described in FIG. 8 have the same characteristics as the separators 100 of the first embodiment of the present invention explained with reference to FIG. 4. That is, the separator 100 separates the cool air into at least two flows before discharging the cool air, thereby decreasing the flow speed of the cool air. By the separation of the cool air, it is possible to form at least two vortexes A between the separator 100 and the opening 62. Also, two jets B are formed by the passage, and the two jets B collide with each other, to increase the turbulence of the flow. Thus, the cool exiting the opening 62 is uniformly diffused to the entire evaporator 71.

Also, the opening 62 is provided adjacent to the crossing point of meeting the two jets B, so as to prevent the excited cool air from being lost. For this reason, an interval H1 between the separator 100 and the opening 62 is same as (or smaller than) a width D2 of the opening 62. Preferably, the interval H1 is 0.5 times of the width D2 of the opening 62. For ideal formation of the vortex A and the jet B, a width of the separator 100 is same as the width D2 of the opening 62.

Figure 9A:
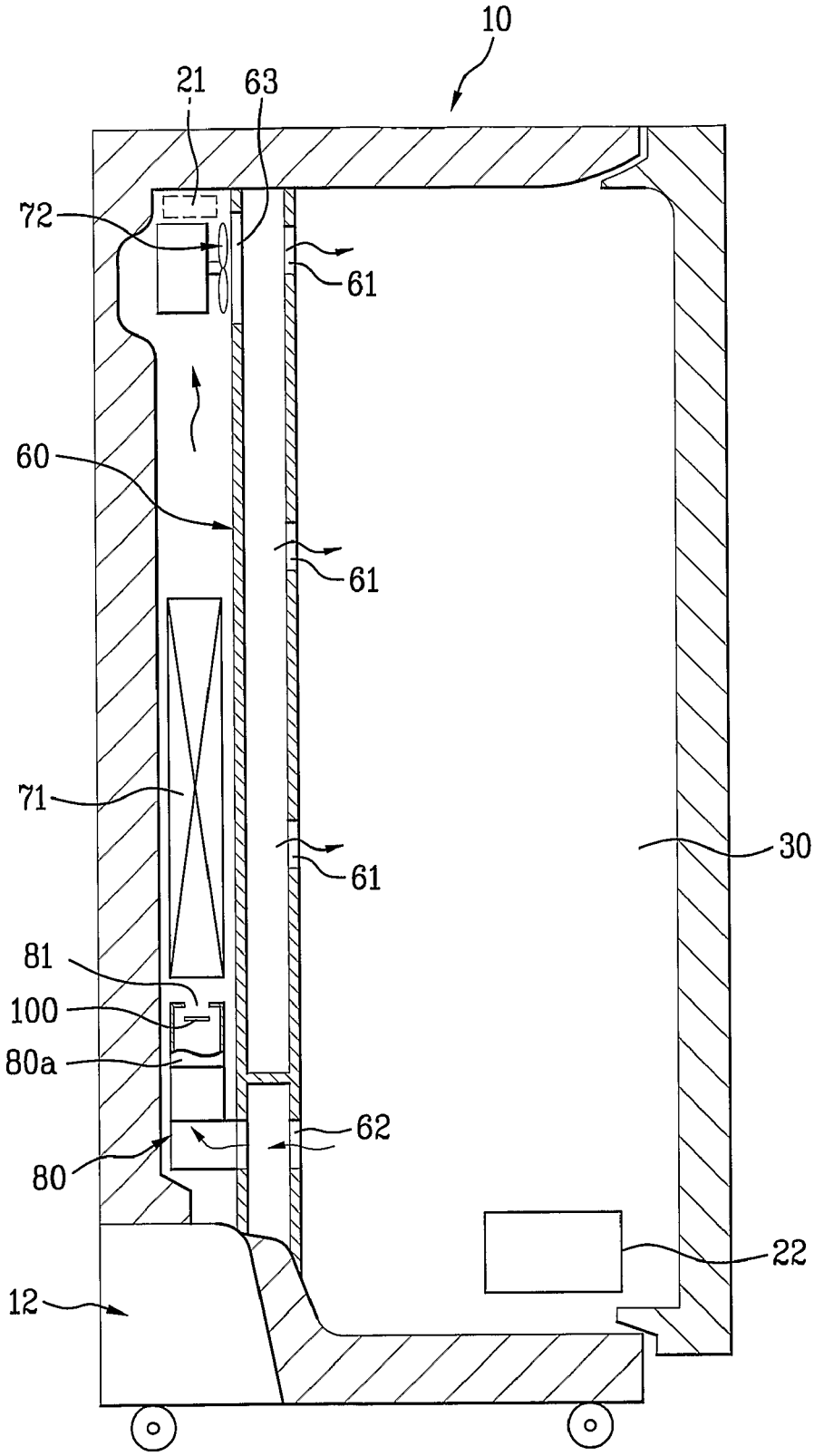
FIG. 9A and FIG. 9B are cross sectional and schematic views of a modified refrigerator according to the second embodiment of the present invention.
Figure 9B:
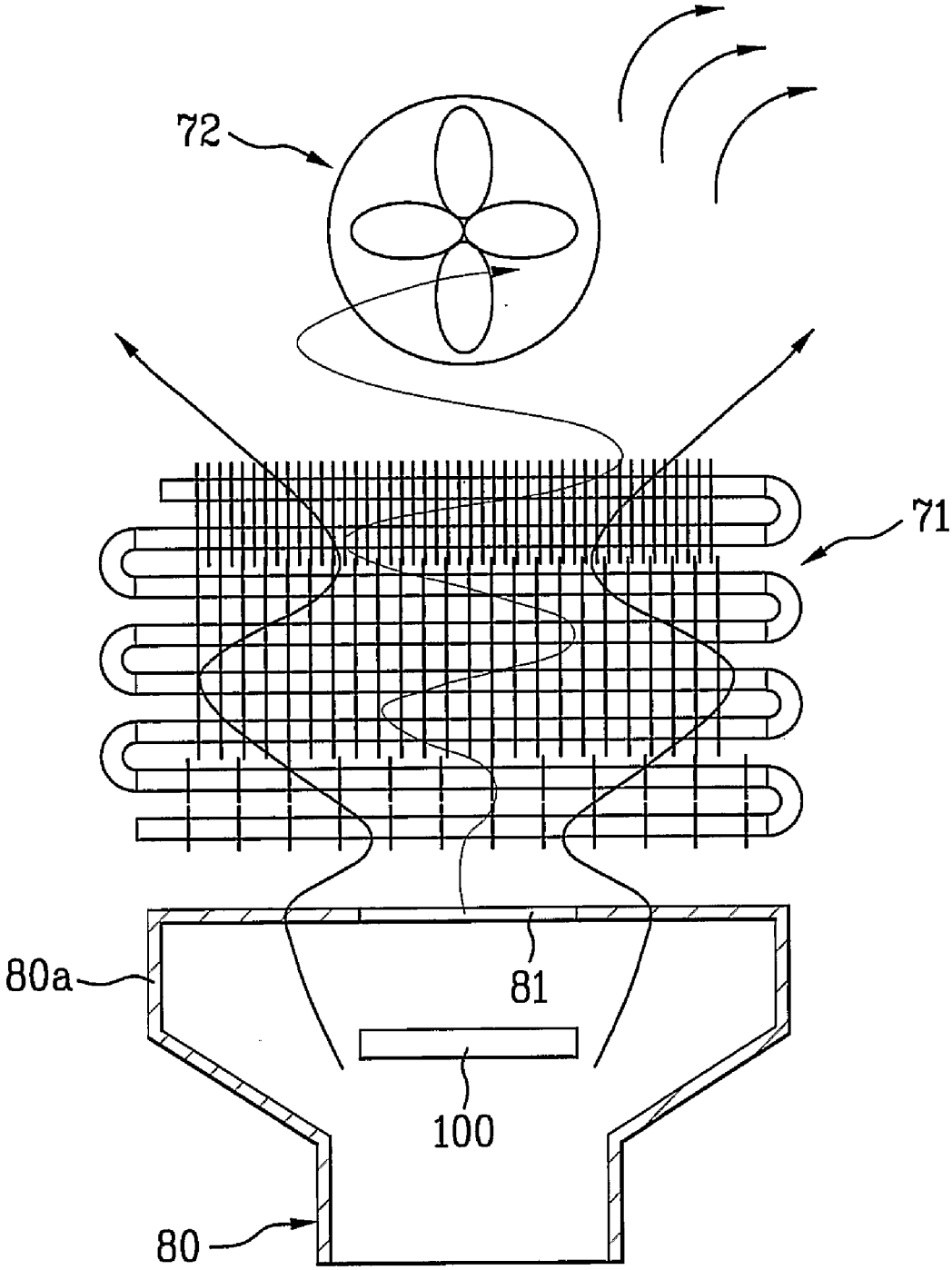

To smoothly guide the cool air to the evaporator 71, preferably, as shown in FIG. 9A and FIG. 9B, the second supplying part may include an additional auxiliary duct 80. The auxiliary duct 80 is in communication with the fourth opening 62, and is extended so that it is adjacent to the evaporator 71. Furthermore, the auxiliary duct 80 includes an auxiliary opening 81 oriented toward the evaporator 71, and the separator 100 is provided adjacent to the auxiliary opening 81. Thus, as the cool air passes through the freezing chamber 30 and the refrigerating chamber 40, the cool air is oscillated by the separator 100, and is directly discharged to the evaporator 71. As a result, the cool air is uniformly diffused over the entire evaporator 71.

In both the aforementioned first and second embodiments of the present invention, it is possible to improve the efficiency of the separator 100 by modification, which will be explained with reference to FIG. 10A to FIG. 12B.

Figure 10A:
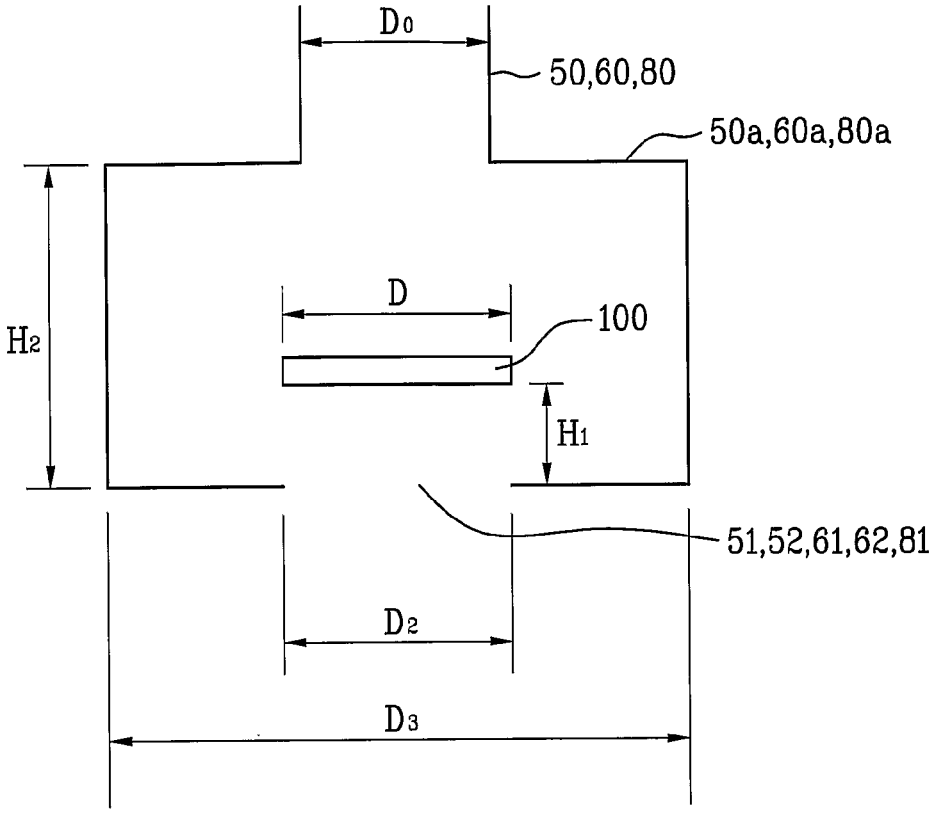
FIG. 10A and FIG. 10B are schematic views illustrating a modified duct which can be applied to the first and second embodiments of the present invention.

First, as shown in FIG. 10A, preferably, the first, and second auxiliary ducts 50, 60, 80 are partially expanded at the portions adjacent to the separators 100. That is, the expanded portions 50*a*, 60*a*, 80*a* substantially enlarge the circumferential space adjacent to the separators 100, which causes the flow speed of the cool air to decrease in the expanded portions 50*a*, 60*a*, 80*a*. Thus, the separators 100 decrease the loss on flow resistance, and simultaneously, separate the cool air.

Preferably, the width D3 of the expanded portions 50*a*, 60*a*, and 80*a* is 2 to 2.5 times the width D0 of the ducts 50, 60, and 80. The height H2 of the expanded portions 50*a*, 60*a*, and 80*a* is 1 to 1.2 times of the width DO of the ducts 50, 60, and 80. Also, as shown in FIG. 4 and FIG. 8, the width D of the separator 100 is equivalent to (or smaller than) the width D0 of the ducts 50, 60, and 80, and the width D2 of the first to fourth openings and the auxiliary openings 51, 52, 61, 62, and 81. Also, the interval H1 is equivalent to (or smaller than) the width D2 of the openings 51, 52, 61, 62, and 81. Preferably, the interval H1 is 0.5 times the width D2 of the openings 51, 52, 61, 62, and 81.

Figure 10B:
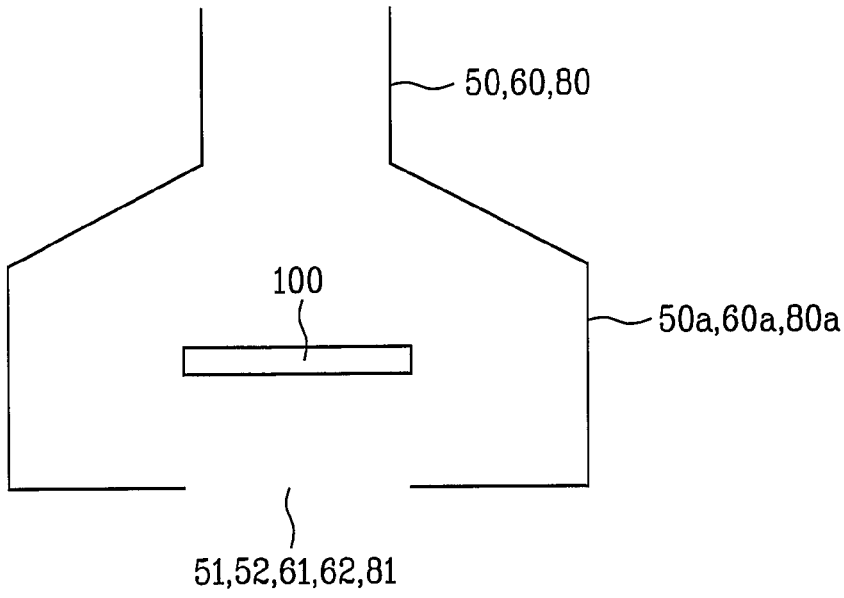

If the ducts 50, 60, and 80 expand rapidly and largely, the cool air momentarily has large resistance and great loss. Accordingly, as shown in FIG. 10B, the expanded portions 50*a*, 60*a*, and 80*a* preferably have the structure of gradually expanding the ducts 50, 60, and 80. That is, the sidewalls of the expanded portions 50*a*, 60*a*, and 80*a* are inclined at a predetermined angle relative to the sidewalls of the ducts 50, 60, and 80. Thus, the shape of the expanded portions 50*a*, 60*a*, and 80*a* substantially decreases the energy loss generated by the flow resistance.

If the separator 100 is formed of a flat member, the flow resistance is great, which generates an energy loss in flowing the air. As described above, a drag coefficient of the flat member is 2.0. To reduce this energy loss, it is preferable to select a separator 100 having a smaller drag coefficient.

Figure 11A:
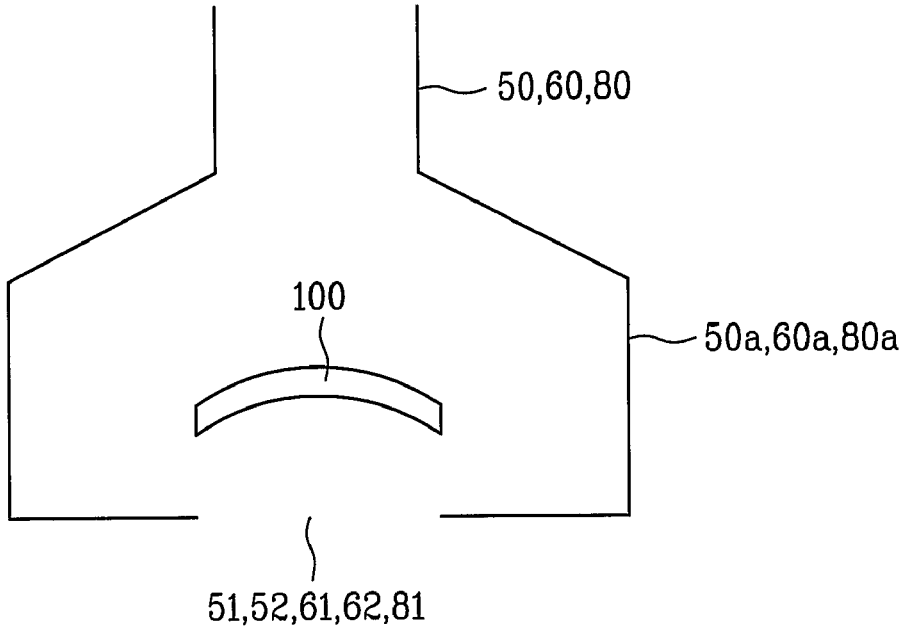
FIG. 11A to FIG. 11C are schematic views illustrating modified separators which can be applied to the first and second embodiments of the present invention.
Figure 11B:
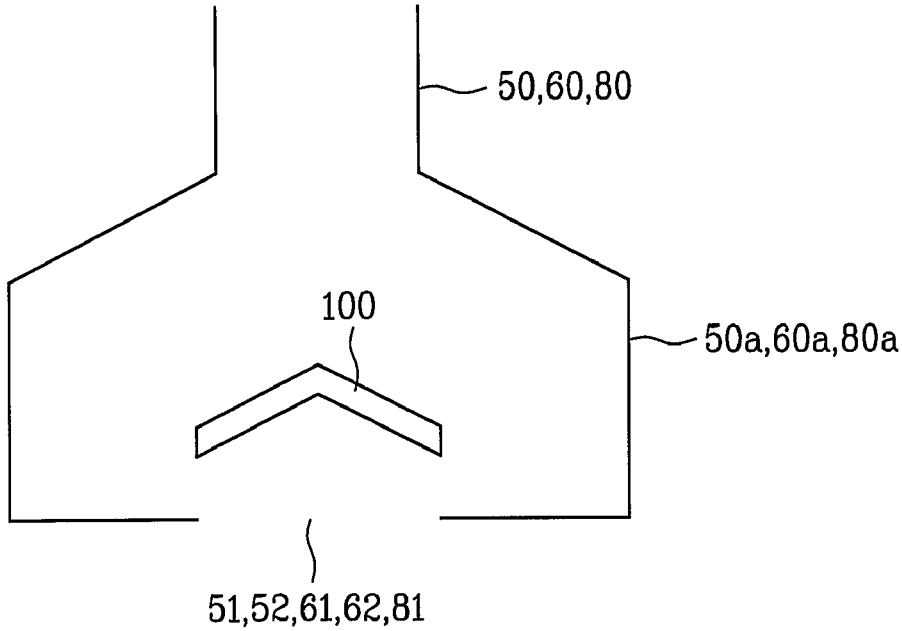

First, as shown in FIG. 11A, the separator 100 may be formed in a curved shape. Also, the curved ends of the separator 100 extend in the same direction as the flowing direction of the cool air. In this case, the drag coefficient of the separator 100 is about 1.40. Also, as shown in FIG. 11B, the separator 100 may be formed in an angularly bent shape, wherein the ends of the separator 100 extend in the same direction as the flowing direction of the cool air. The separator 100 shown in FIG. 11B has a drag coefficient of about 1.20.

Figure 11C:
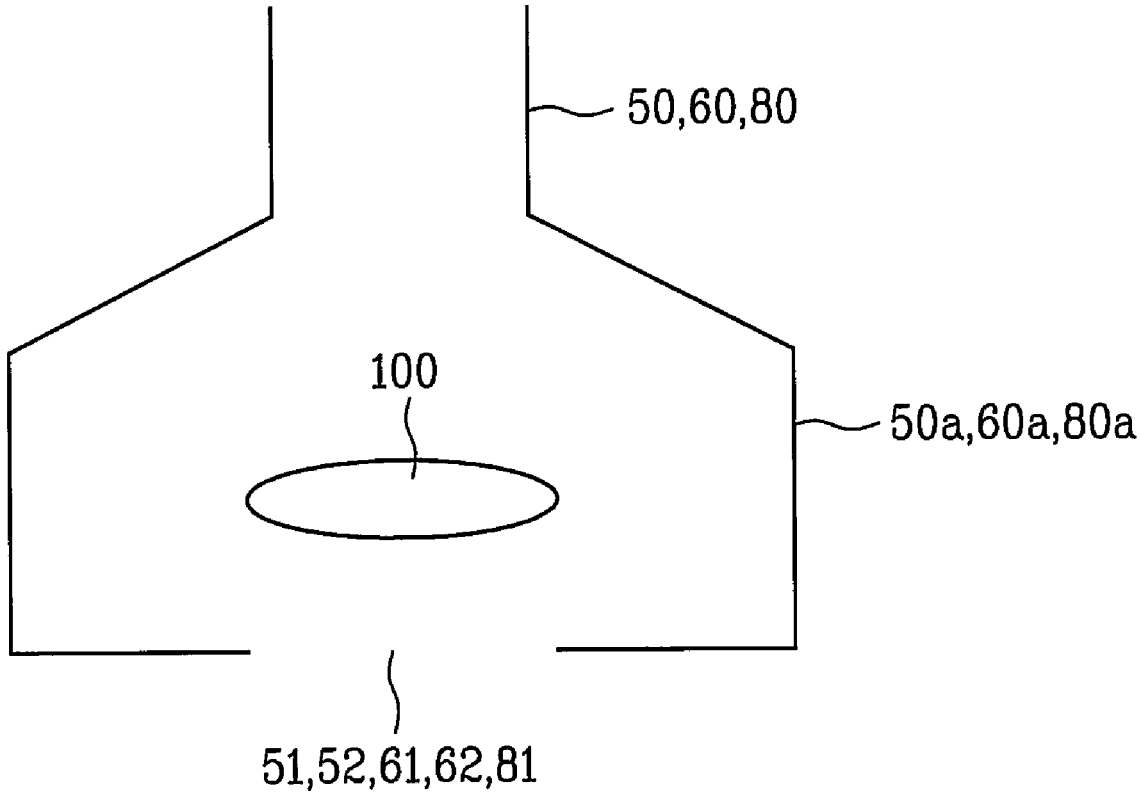

Alternatively, as shown in FIG. 11C, the separator 100 may be formed in an oval shape, where both sides are rounded. The oval-shaped separator 100 has a drag coefficient which varies, depending on the characteristics on the circumferential flow boundary layer. More specifically, when the separator forms a laminar boundary layer, the drag coefficient is smaller than a drag coefficient of the separators of FIG. 11B and FIG. 11C. When the separator forms a turbulent boundary layer, the drag coefficient is much smaller. Also, a plurality of protrusions or dimples may be formed on the surface of the separator according to other modifications of the present invention. The protrusions or dimples induce the formation of the turbulent boundary layer around the separator 100, thereby decreasing the drag coefficient.

Figure 12A:
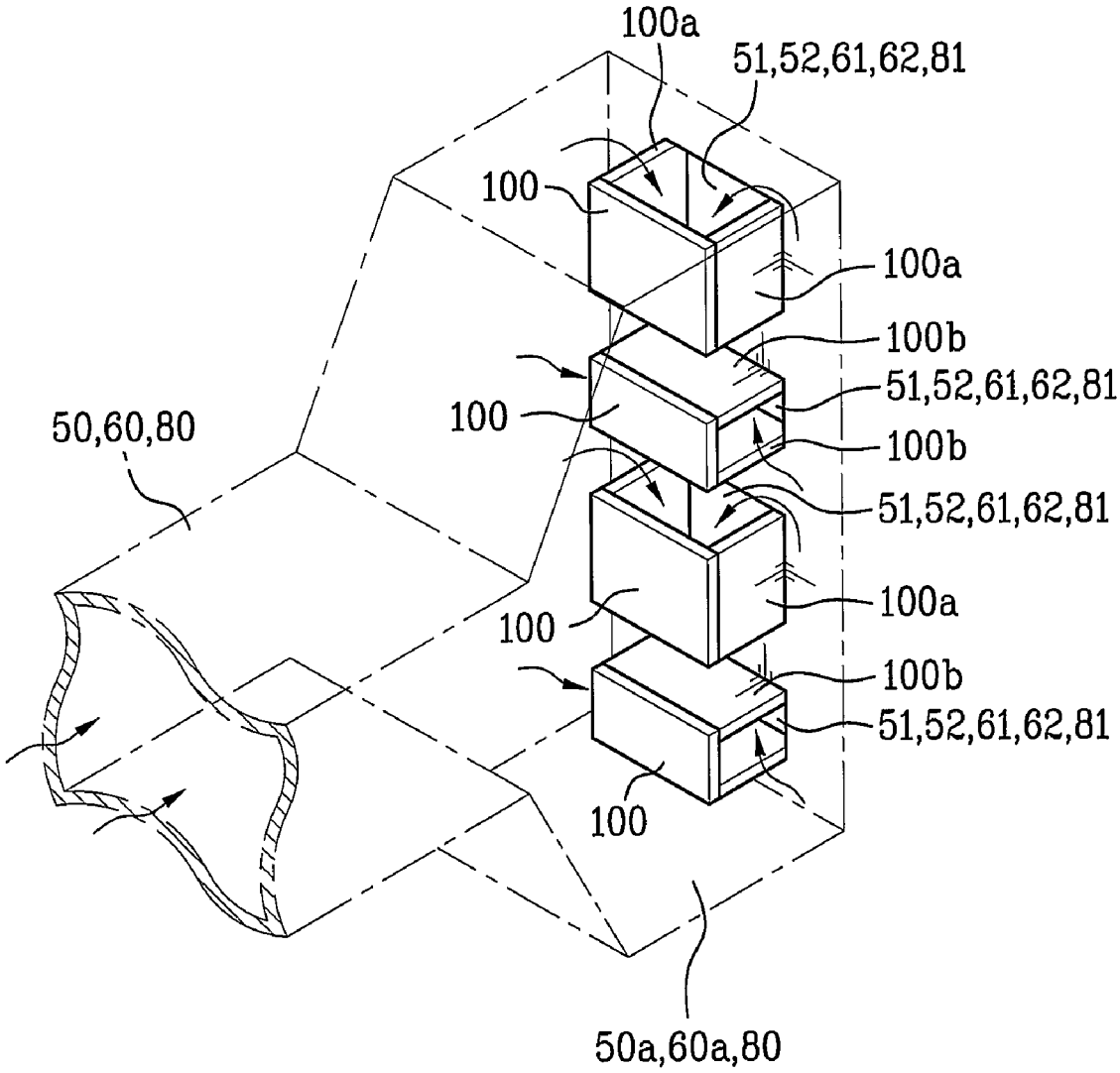
FIG. 12A and FIG. 12B are perspective and front views illustrating a modified combination of a separator and an opening, which can be applied to the first and second embodiments of the present invention.
Figure 12B:
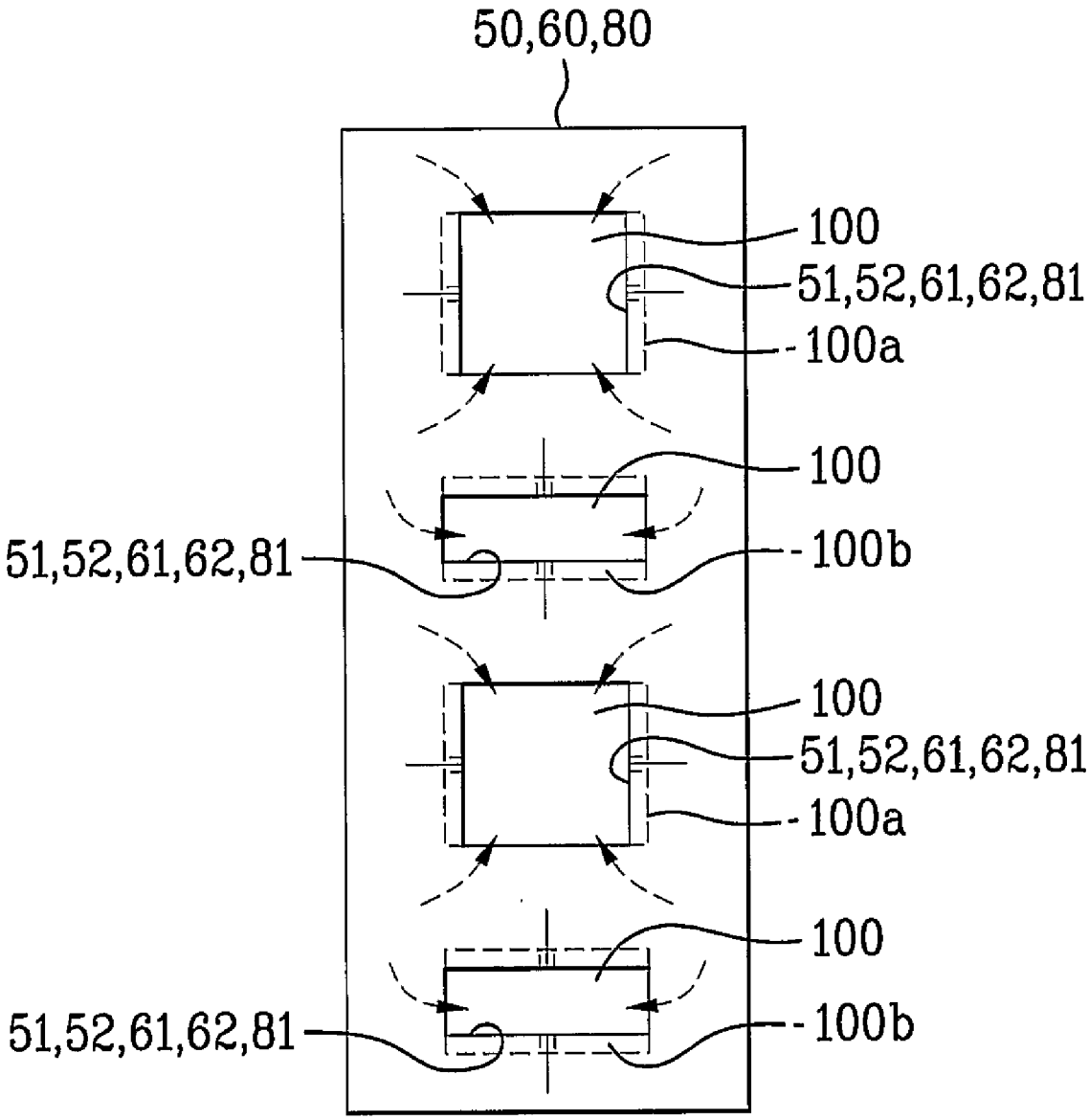

As shown in FIG. 12A and FIG. 12B, in the aforementioned first and second embodiments of the present invention, the plurality of openings 51, 52, 61, 62, and 81 are formed in each of the corresponding ducts 50, 60, and 80. In this case, the openings 51, 52, 61, 62, and 81 are provided adjacent to one another, and the ducts 50, 60 and 80 are connected with the openings. As shown in the drawings, one duct may be connected with a plurality of openings 51, 52, 61, 62, and 81 that are adjacent to one another. Alternatively, a plurality of ducts may be respectively connected with the plurality of openings. The plurality of separators 100 are respectively provided to the openings 51, 52, 61, 62, and 81. In this state, the openings 51, 52, 61, 62, and 81 have the alternately changed sizes, and the respective separators 100 also have the sizes equivalent to the corresponding openings 51, 52, 61, 62, and 81.

Also, pairs of first supports 100*a* and pairs of second supports 100*b* are alternately extended from the opposite sides of the separators 100 to the edges of the openings 51, 52, 61, 62, and 81, to support the separators 100. The orientation of the first supports 100*a* is different from the orientation of the pairs' second supports 100*b*. In more detail, as shown in the drawings, the first supports 100*a* support the left and right sides of the separators 100. Meanwhile, the second supports 100*b* support the lower and upper sides of the separators 100. According to this arrangement of the first and second supports 100*a* and 100*b*, the adjacent separators 100 separate the discharged cool air in different directions. That is, the separators 100 separate the cool air into lower and upper flow directions with the first supports 100*a*, and separate the cool air into left and right flow directions with the second supports 100*b*.

Vortexes are generated at the lower and upper sides of the separators 100 by the first supports 100*a*, and then the cool air is oscillated up and down, and is discharged through the openings 51, 52, 61, 62, and 81. Also, vortexes are generated at the left and right sides of the separators 100 by the second supports 100*b*, and then the cool air is oscillated to the left and right sides, and is discharged through the openings.

Accordingly, the turbulent intensity of the flowing air firstly heightens in the ducts 50, 60, and 80, so that the oscillation of the cool air becomes greater. Also, the separators 100 oscillate the cool air in different directions, for example, at perpendicular directions. Thus, after the adjacent passages of the flowing air are discharged, the adjacent passages of the flowing air instantly interfere and mix with one another, thereby forming a severe turbulent flow. As a result, the discharged cool air is uniformly diffused in the freezing chamber and the refrigerating chamber.

As mentioned above, a refrigerator according to the present invention has many advantages. In a refrigerator according to the present invention, the separators oscillate the discharged cool air, so that the discharged cool air is uniformly diffused in the freezing chamber, the refrigerating chamber, and at the evaporator. Accordingly, it is possible to perform the heat exchange in the refrigerating/freezing chambers in a short period of time, thereby improving the efficiency in the refrigerator.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A refrigerator comprising:

a body;

at least one storage chamber provided in the body and configured to store food;

a cool air generating device provided in the body and configured to generate a flow of cool air;

a cool air supplying device configured to circulate air between the at least one storage chamber and the cool air-generating device wherein the cool air supplying device includes a first opening that discharges cool air into the at least one storage chamber in a first direction, and a second opening that discharges cool air into the at least one storage chamber in a second direction; and a first separator provided adjacent to the first opening and a second separator provided adjacent to the second opening, each separator configured to separate a flow of cool air in the cool air supplying device into at least two flows such that the cool air discharged from the first opening and the second opening into the storage chamber comprises a turbulent flow that is uniformly distributed through the storage chamber, wherein the first and second openings are positioned such that the turbulent flow in the first direction is substantially perpendicular to the turbulent flow in the second direction, and wherein the turbulent flow in the first direction crosses the turbulent flow in the second direction inside the at least one storage chamber.

2. The refrigerator as claimed in claim 1, wherein each separator is configured to partially block the flow of cool air exiting from the cool air supplying device via each corresponding opening.

3. The refrigerator as claimed in claim 1, wherein each separator extends in a direction that is substantially perpendicular to a flowing direction of the cool air.

4. The refrigerator as claimed in claim 1, wherein each separator causes the discharged cool air to form an oscillating flow.

5. The refrigerator as claimed in claim 1, wherein each separator causes the flow of cool air in the cool air supplying device to form at least two vortexes adjacent the at least one opening, and wherein the at least two vortexes rotate opposite to one another.

6. The refrigerator as claimed in claim 5, wherein the vortexes have a size and an intensity that are different and that continuously change.

7. The refrigerator as claimed in claim 1, wherein each separator is configured to cause the separated two flows of the cool air to collide with each other before they are discharged into the storage chamber.

8. The refrigerator as claimed in claim 1, wherein the separated flows of the cool air collide with each other substantially head on.

9. The refrigerator as claimed in claim 1, wherein the separated flows of the cool air collide with each other at a predetermined angle.

10. The refrigerator as claimed in claim 1, wherein two opposite passages are formed between each separator and each corresponding opening, and the separated flows of cool air flow along the two opposite passages.

11. The refrigerator as claimed in claim 1, wherein the separated two flows mix together after passing each separator, and wherein each corresponding opening is positioned adjacent to a point where the separated flows of the cool air cross one another and mix together.

12. The refrigerator as claimed in claim 1, wherein a length of an interval between each separator and each corresponding opening is less than or equal to a width of the opening.

13. The refrigerator as claimed in claim 1, wherein a length of an interval between each separator and each corresponding opening is about 0.5 times of a width of the at least one opening.

14. The refrigerator as claimed in claim 1, wherein a width of each separator is substantially equivalent to a width of each corresponding opening.

15. The refrigerator as claimed in claim 1, wherein each opening includes:

a first inlet provided on a top wall of the storage chamber and configured, to discharge cool air toward a lower portion of the storage chamber; and a second inlet provided on an upper sidewall of the storage chamber and configured to discharge the cool air toward an opposite sidewall of the storage chamber.

16. The refrigerator as claimed in claim 15, wherein each opening further includes at least one outlet provided at a lower portion of the storage chamber and configured to discharge cool air from within the storage chamber towards the cool air generating device.

17. The refrigerator as claimed in claim 16, wherein the at least one outlet comprises at least two outlets that are provided, respectively, on lower portions of opposite sidewalls of the storage chamber.

18. The refrigerator as claimed in claim 1, wherein the cool air supplying device comprises an outlet configured to discharge cool air from the storage circulated in the freezing chamber to the cool air generating device.

19. The refrigerator as claimed in claim 18, wherein the outlet discharges the cool air from the storage chamber to an evaporator of the cool air generating device.

20. The refrigerator as claimed in claim 1, wherein the cool air supplying device comprises at least one duct that passes between the cool air generating device and the first and second openings, and wherein a diameter of the at least one duct expands toward the inside of the storage chamber.

21. The refrigerator as claimed in claim 20, wherein the at least one duct has an expanded portion that is adjacent to each separator.

22. The refrigerator as claimed in claim 21, wherein a width of the expanded portion is about 2 to 2.5 times a width of the remaining portions of the at least one duct.

23. The refrigerator as claimed in claim 21, wherein a height of the expanded portion is about 1 to 1.2 times a width of the remaining portions of the at least one duct.

24. The refrigerator as claimed in claim 20, wherein the expanded portion of the at least one duct has a width that gradually expands.

25. The refrigerator as claimed in claim 1, wherein the at least two flows formed by the separator in the auxiliary duct mix back together before exiting the opening of the auxiliary duct to thereby form a turbulent flow of air exiting the opening of the auxiliary duct.

26. A refrigerator comprising:

a body;

at least one storage chamber provided in the body and configured to store food;

a cool air generating device provided in the body and configured to generate a flow of cool air;

a cool air supplying device configured to circulate air between the at least one storage chamber and the cool air generating device wherein the cool air supplying device includes a first and second openings that discharges cool air into the at least one storage chamber; and at least one first plate provided at a first predescribed distance from the first opening having a first predescribed width; and at least one second plate provided at a second predescribed distance from the second opening having a second predescribed width, wherein the at least one first and second plates are fixed in a permanent position and are not connected to each other, and wherein the first predescribed distance of the at least one first plate from the first opening is less than or equal to the first predescribed width of the first opening and greater than one half of the first predescribed width of the first opening, wherein at least one opening of the cool air supplying device includes a first opening and a second opening that discharges the turbulent flow into the at least one storage chamber in a first direction and a second direction, wherein the first and second openings are positioned such that the turbulent flow in the first direction is substantially perpendicular to the turbulent flow in the second direction, and wherein the turbulent flow in the first direction intersects the turbulent flow in the second direction inside the at least one storage chamber.

27. The refrigerator of claim 26, wherein the second predescribed distance of the at least one second plate from the second opening is less than or equal to the second predescribed width of the second opening and greater than one half of the second predescribed width of the second opening.

* * * * *